US009943737B1

(12) United States Patent
Burdan

(10) Patent No.: US 9,943,737 B1
(45) Date of Patent: Apr. 17, 2018

(54) TARGET GAME SYSTEM AND METHOD

(71) Applicant: James B. Burdan, Sarnia (CA)

(72) Inventor: James B. Burdan, Sarnia (CA)

( * ) Notice: Subject to any disclaimer, the term of this patent is extended or adjusted under 35 U.S.C. 154(b) by 0 days.

(21) Appl. No.: 15/284,402

(22) Filed: Oct. 3, 2016

(51) Int. Cl.
*A63B 67/06* (2006.01)
*A63B 71/00* (2006.01)
*A63H 33/18* (2006.01)
*A63B 63/00* (2006.01)

(52) U.S. Cl.
CPC ..... *A63B 67/06* (2013.01); *A63B 71/0036* (2013.01); *A63H 33/18* (2013.01); *A63B 63/00* (2013.01); *A63B 2207/02* (2013.01); *A63B 2210/50* (2013.01)

(58) Field of Classification Search
CPC ..... A63B 63/00; A63B 67/06
USPC ..... 273/398–403
See application file for complete search history.

(56) References Cited

U.S. PATENT DOCUMENTS 2,008,359 A * 7/1935 Lamb ..... A63F 9/0208 273/342
2,247,852 A * 7/1941 Saunders ..... A63B 63/083 224/637
3,544,109 A 12/1970 Woods
3,895,801 A * 7/1975 Baird ..... A63B 63/00 273/350
D237,808 S * 11/1975 Ekstrand ..... 273/400
4,160,549 A * 7/1979 Simpson ..... A63B 61/006 273/354
4,168,066 A 9/1979 Sole et al.
D257,779 S * 1/1981 Sippola ..... D21/699
4,635,943 A * 1/1987 Lumpkin ..... A63B 67/06 273/354
4,936,578 A * 6/1990 Hudson, Sr. ..... A63B 63/00 273/402
4,955,607 A * 9/1990 Maye ..... A63B 63/00 473/456
D317,033 S * 5/1991 Rains ..... D21/705
5,382,028 A 1/1995 Sciandra et al.
5,524,901 A * 6/1996 Bison ..... A63B 63/00 273/400
5,941,529 A * 8/1999 Kinsey ..... A63B 63/00 273/401

(Continued)

FOREIGN PATENT DOCUMENTS

WO 2005074567 8/2005

*Primary Examiner* — Mark Graham
(74) *Attorney, Agent, or Firm* — Integrity Patent Group, PLC; Edwin Wold

(57) ABSTRACT

A target game system including a target game device having a plurality of hoop members arranged in stacked relationship, each hoop member including a frame defining an elongated central opening through which a tossable item may pass, the elongated central opening having an opening width greater than an opening height, coupled to the frame, a capture net configured to capture the tossable item passing through the central opening, and at least one coupler configured to removably couple the hoop member with at least one other hoop member of the plurality. In addition, each target game device includes a vertical support member configured to support the plurality of hoop members above a ground surface, the vertical support member including a ground-engaging stabilizer configured to positionally stabilize the vertical support member by engagement with the ground surface.

14 Claims, 5 Drawing Sheets

(56) References Cited

U.S. PATENT DOCUMENTS 5,944,318 A * 8/1999 Payton ..... A63B 63/00 273/402
5,954,337 A * 9/1999 Cunningham ..... A63B 67/06 273/338
6,432,002 B1 * 8/2002 Pavonetti ..... A63B 63/004 273/400
6,808,175 B1 * 10/2004 Gleeson ..... A63B 43/007 273/343
6,834,858 B1 * 12/2004 Reineke ..... A63B 63/00 273/400
6,889,982 B1 * 5/2005 Gove ..... A63B 63/00 273/343
7,540,814 B2 6/2009 Dilling
8,827,845 B1 9/2014 Griffin
D775,692 S * 1/2017 Tedeschi ..... D21/303
2005/0269784 A1 * 12/2005 Peters ..... A63B 67/00 273/343
2006/0097454 A1 5/2006 Mattson
2007/0213146 A1 9/2007 Lagergren et al.
2008/0111312 A1 * 5/2008 Longo ..... A63B 67/06 273/402
2008/0224409 A1 9/2008 Marshall et al.
2008/0252017 A1 * 10/2008 Rowan ..... A63B 63/00 273/400
2010/0062880 A1 * 3/2010 Hayes ..... A63B 63/003 473/422
2010/0140873 A1 * 6/2010 Britton ..... A63B 63/00 273/398
2011/0195805 A1 8/2011 Sliger et al.
2014/0145401 A1 * 5/2014 Powers ..... A63B 67/06 273/402
2014/0183823 A1 * 7/2014 Deming ..... A63B 67/06 273/371
2015/0031480 A1 1/2015 Kidd et al.
2016/0023095 A1 * 1/2016 Nally ..... A63B 67/06 273/343

* cited by examiner

100

TARGET GAME SYSTEM AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of games using tangible projectiles and more specifically relates to games using an elevated, horizontally disposed goal or target.

2. Description of Related Art

Tossing games are universally popular and take a wide variety of forms. One form consists of a player or players hitting a target with a thrown projectile. For example, U.S. Pat. No. 5,382,028 to Sciandra et al. relates to an apparatus and a method of play for a disc tossing game. The described apparatus and a method of play for a disc tossing game includes two tapered, generally cylindrical containers with a slot in their sides and a disc with dull edges. When the disc tossing game is played in a yard or a park, the containers may have an open top and a closed bottom with the top having a larger diameter than the bottom. When the disc tossing game is played on a beach or indoors, e.g., in an indoor gymnasium, the containers may have an open top and an open bottom where the top has a smaller diameter than the bottom. The players always have an option as to which container is used in any type of playing situation. When the disc tossing game is played, the two containers are placed at a distance from each other and the disc is tossed at each of the containers in turn with each toss being scored and a winner being declared when one of two two-player teams reaches a score of exactly twenty-one.

The worldwide popularity of such recreational games creates a constant demand for new game apparatus and methods of use, particularly those that may be played by many age groups, are easy to transport and set up, and are suitable for both outdoor and indoor play. Thus, there remains opportunities in the field to develop new game apparatus and methods of use to fill this constant need.

BRIEF SUMMARY OF THE INVENTION

In view of the continuous need for new recreational devices and methods of use in the known games using tangible projectiles art, the present disclosure provides a novel target game system. The general purpose of the present disclosure, which will be described subsequently in greater detail, is to provide a target game system and methods of use.

A target game system is disclosed herein. The target game system includes a target game device having a plurality of hoop members arranged in stacked relationship, each hoop member including a frame defining an elongated central opening through which a tossable item may pass, the elongated central opening having an opening width greater than an opening height. Coupled to the frame is a capture net configured to capture the tossable item passing through the central opening and at least one coupler configured to removably couple the hoop member with at least one other hoop member of the plurality. In addition, each target game device includes a vertical support member configured to support the plurality of hoop members above a ground surface, the vertical support member including a ground-engaging stabilizer configured to positionally stabilize the vertical support member by engagement with the ground surface.

According to another embodiment, a target game system is also disclosed herein. The target game system includes a target game device having a plurality of hoop members arranged in stacked relationship, each hoop member including a frame defining an elongated central opening through which a tossable item may pass, the elongated central opening having an opening width greater than an opening height. Coupled to the frame is a capture net configured to capture the tossable item passing through the central opening and at least one coupler configured to removably couple the hoop member with at least one other hoop member of the plurality. In addition, each target game device includes a vertical support member configured to support the plurality of hoop members above a ground surface, the vertical support member including a ground-engaging stabilizer configured to positionally stabilize the vertical support member by engagement with the ground surface.

Moreover, it provides such a system wherein the elongated central opening of each hoop member includes an opening area differing from the opening area of each of the other hoop members of the plurality. Additionally, it provides such a system, wherein the plurality of hoop members includes a first hoop member having a first elongated central opening, a second hoop member having a second elongated central opening, and a third hoop member having a third elongated central opening. The first elongated central opening includes a first opening width of about 20 inches and a first opening height of about 4 inches; the second elongated central opening includes a second opening width of about 25 inches and a second opening height of about 8 inches; and the third elongated central opening includes a third opening width of about 30 inches and a third opening height of about 12 inches.

In addition, it provides such a system wherein the frame of each hoop member includes a plurality of elongated bars and a plurality of bar connectors, the plurality of bar connectors configured to interconnect the plurality of elongated bars. In addition, it provides such a system, wherein the plurality of bar connectors includes at least four 90-degree elbow bar connectors and at least one tee bar connector. Furthermore, it provides such a system wherein the coupler includes at least one tee bar connector and a connector bar segment configured to interconnect the tee bar connector with one other tee bar connector of the plurality of hoop members.

Further, it provides such a system, wherein the vertical support member includes a height adjuster configured to adjust the height of the plurality of hoop members relative to the ground structure. Even further, it provides such a system, wherein the ground-engaging stabilizer includes a weighted base configured rest on the ground surface, the weighted base having a socket configured to removably receive the vertical support member and wherein the vertical support member includes an elongated cylindrical bar. Moreover, the weighted base includes a cavity configured to receive a flowable ballast material.

Additionally, it provides such a system, wherein the ground-engaging stabilizer includes a spike configured to be driven into the ground surface. Also, it provides such a system, wherein the ground-engaging stabilizer includes an auger configured to be rotationally driven into the ground surface. In addition, it provides such a system, wherein the ground-engaging stabilizer includes a set of support legs projecting outwardly from the vertical support member.

Additionally, it provides such a system, wherein the target game device is constructed from at least one member of the group consisting of a plastic material, a carbon-fiber composite, a metallic material, and a self-illuminating material. Further, it provides such a system, wherein target game device is self-illuminated. Even further, it provides such a system, wherein target game device includes an arrangement of light emitting diodes and an onboard power source. Even further, the system includes a pair of target game devices.

Even further, it provides such a system, further including a pair of the target game devices, at least one tossable item, a set of instructions, and wherein the target game system is arranged as a kit. Even further, it provides such a system, further including at least one storage bag.

According to another embodiment, a target game method is also disclosed herein, The target game method includes the steps of: providing a pair of target game devices, each target game device including three hoop members arranged in stacked relationship, each hoop member having a uniquely-sized central opening through which a tossable item may pass and a capture net configured to capture the tossable item passing through the central opening; providing at least one tossable item; and providing a set of instructions including assembly instructions and play instructions.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a target game system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to games using tangible projectiles and more particularly to a target game system and method as used to improve backyard/outdoor net-based games using hand-throwable objects and one or more target game devices.

Generally, the presently disclosed target game system includes unique target-goal devices, which allow simple but very fun goal-oriented games to be played. In one version, two opposing target goals are provided, each one having point-assigned nets of differing sizes. Players aim and throw a projectile, such as a flying disc or ball, to score points. Each target-goal device includes three different goal sizes to match all skill sets. The target-goal device is easily assembled and transported to any location, which gets people outside and exercising in a fun way. Thus, the system functions as a super fun game to promote and achieve good times.

To start a game, two or four players assemble the target goals, which may be located about 30 feet apart. The assembled target goals/nets have three different sized goal areas. The top goal is about four inches high and about twenty inches wide and is assigned a value of three points. The second highest goal is about eight inches high and about twenty-five inches wide and is assigned a value of two points. The lowest goal is the largest goal at about twelve inches high and about thirty inches wide and is assigned a value of one point. The principle game is to throw a flying disc (it should be noted that the system is designed to use a flying disc, but multiple projectile options are possible) back and forth trying to be the first to score an agreed to number of points. Supplementary rules of play may include:

1) No blocking is allowed. If the disc is heading to the goal, there is no interference allowed; however, if the disc is off course and a player can tip the disc into a net, the player will receive the points associated with the net.
2) Throws must be made from behind the edge of the player's goal not in front.
3) Any blocking or stepping in front of or ahead of the foul line forfeits one point.
4) "Trash talk" or other distractions are both allowed and encouraged to promote lively play.

The present game system is designed to be easily transported and different bases allowing the targets to be set up in both grass and in the sand, as well as having a weighted base to be able to utilize the targets while tailgating in a parking lot or similar situation. A self-illuminated version using light emitting diodes (LEDs) and clear tubing for night play is envisioned. A "high end" version constructed of carbon fiber is also envisioned. A beach application may be used in water at waist height for fun water play. The beach version may use flying disc or a skipping-type ball for alternate game use.

Figure 1:
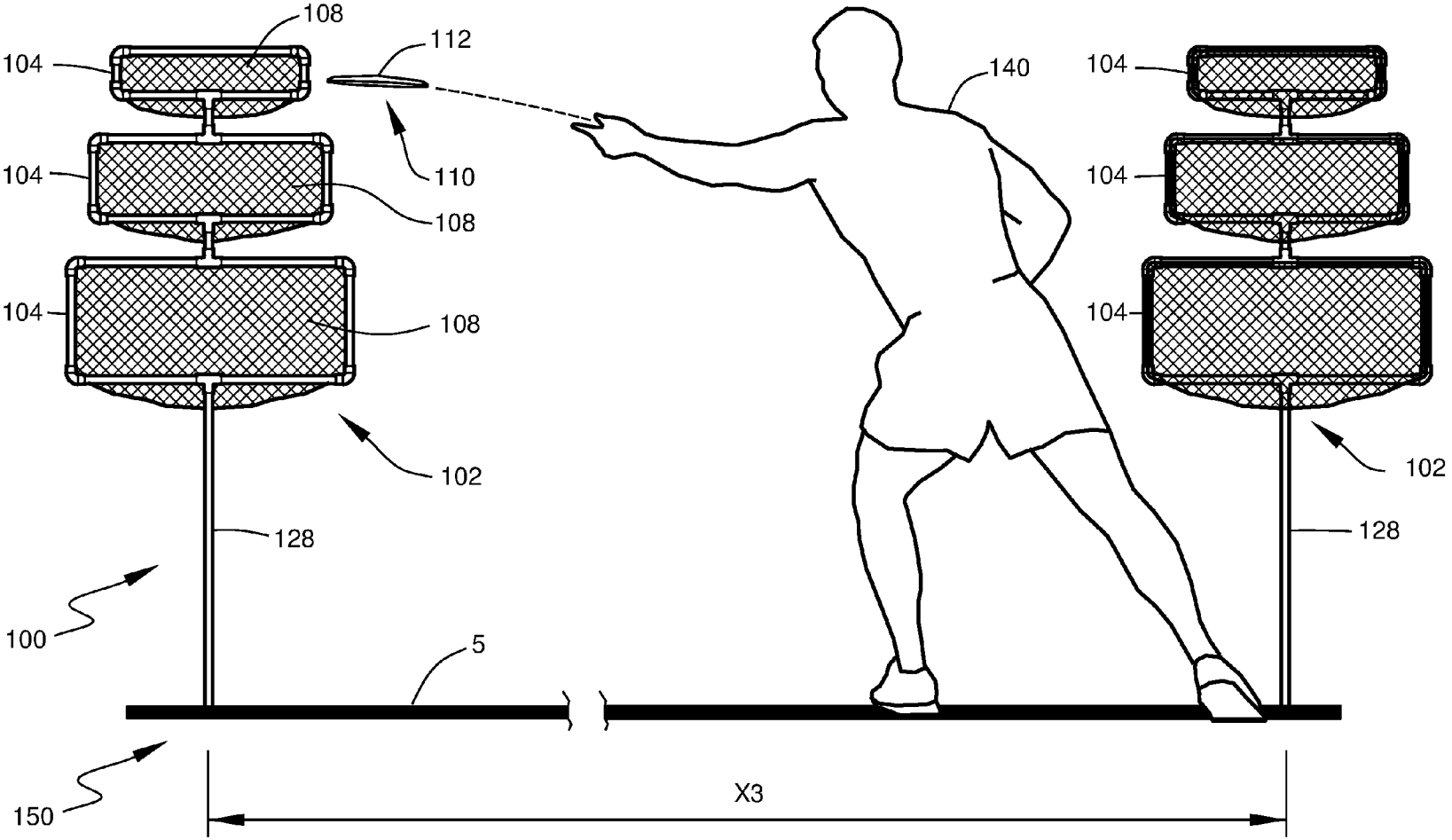
FIG. 1 is a perspective view of the target game system during an 'in-use' condition, according to an embodiment of the disclosure.

Referring now more specifically to the drawings by numerals of reference, there is shown in FIGS. 1-7, various views of a target game system 100. FIG. 1 shows a target game system 100 during an 'in-use' condition 150, according to an embodiment of the present disclosure. Here, the target game system 100 may be beneficial for use by a user 140 to allow target-goal oriented games to be played. As illustrated, the target game system 100 may include a pair of portable goals identified in the present disclosure as target game devices 102. The players may place the target game devices 102 in a spaced-apart arrangement at any chosen separation distance X3. As one example, the separation distance X3 may be about 30 feet; however, the separation distance X3 may be increased for more challenging play or reduced for younger players.

Figure 2:
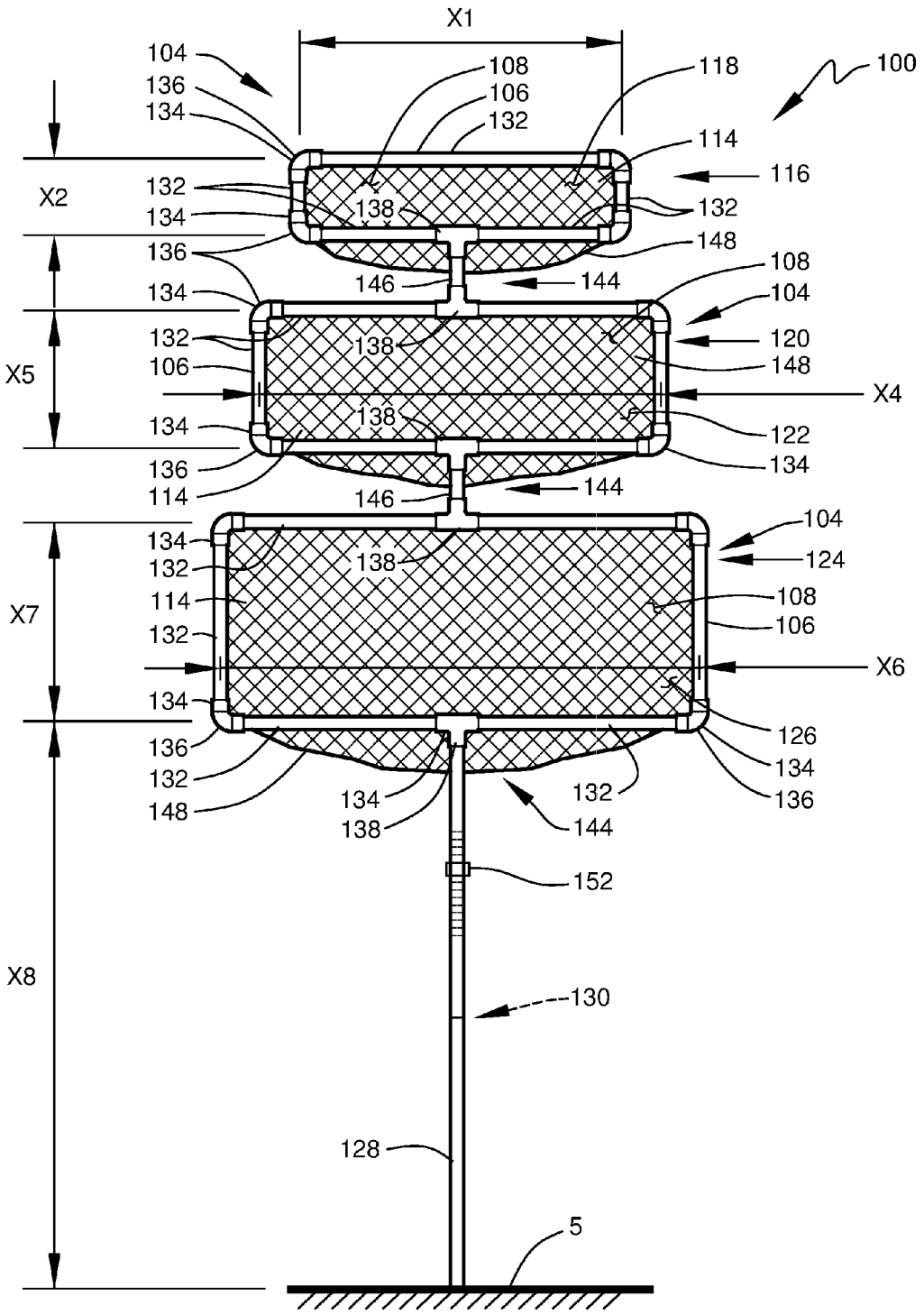
FIG. 2 is a front view of a target game device of the target game system of FIG. 1, according to an embodiment of the present disclosure.

As illustrated in FIG. 1 and FIG. 2, each of the target game devices 102 may include a plurality of hoop members 104 arranged in stacked relationship. Each hoop member 104 includes a frame 106 defining an elongated central opening 108 through which a hand-tossable item 110 such as a flying disc 112 or similar item may pass, as suggested in FIG. 1. Each elongated central opening 108 has an opening width that is greater than the opening height, as shown.

The elongated central opening 108 of each hoop member 104 includes an opening area 114 differing from the opening area 114 of each of the other hoop members of the plurality. The plurality of hoop members 104 includes a first hoop member 116 having a first elongated central opening 118, a second hoop member 120 having a second elongated central opening 122, and a third hoop member 124 having a third elongated central opening 126.

The first elongated central opening 118 includes a first opening width X1 of about 20 inches and a first opening height X2 of about 4 inches. The second elongated central opening 122 includes a second opening width X4 of about 25 inches and a second opening height X5 of about 8 inches. The third elongated central opening 126 includes a third opening width X6 of about 30 inches and a third opening height X7 of about 12 inches.

The unusual asymmetrical geometry of the frames 106 tests a player's ability to control the elevation of a throw during play. More specifically, a player's skill at hitting a specific central opening is more dependent on the player's ability to control the elevational trajectory of the throw relative to the player's side-to-side accuracy.

Each target game device 102 includes a vertical support member 128 configured to support the plurality of hoop members 104 above a ground surface 5. The vertical support member 128 may comprise a rigid cylindrical bar having a length X8 of about 32 inches. Embodiments of the vertical support member 128 include a height adjuster 130 (shown in dashed-line depiction) configured to adjust length X8, thus altering the height of the plurality of hoop members 104 relative to the ground surface 5. The height adjuster 130 may consist of a set of tubular members releasably secured together in a nested telescoping relation. A locking mechanism, such as an arrangement of spring-loaded detents or similar mechanism, may be used to fix the nested tubes in a selected relationship. Upon reading this specification, it should be appreciated that, under appropriate circumstances, considering such issues as user preferences, design preference, structural requirements, marketing preferences, cost, available materials, technological advances, etc., other height-adjusting arrangements such as, for example, providing a set of interlocking segments which may be combined to form a selected length, providing vertical support members of varying lengths, etc., may be sufficient.

In the depicted embodiment of the present disclosure, the frame 106 of each hoop member 104 is formed from a plurality of elongated bars 132 and a plurality of bar connectors 134, as shown. The elongated bars 132 may have a cylindrical cross section. To reduce weight, the elongated bars 132 may comprise tubular members having hollow bores.

Figure 3:
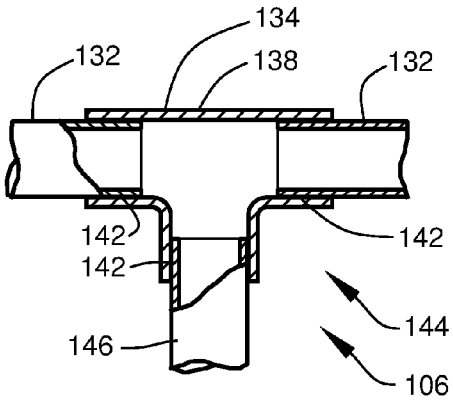
FIG. 3 is a side view, in partial section, of a bar connector of the target game device of FIG. 2, according to an embodiment of the present disclosure FIG. 4. is a side view of the target game device of FIG. 1, according to an embodiment of the present disclosure.

FIG. 3 is a side view, in partial section, of a bar connector 134 of the target game device 102 of FIG. 2. In specific reference to FIG. 3 and in continued reference to the prior illustrations, the plurality of bar connectors 134 are configured to interconnect the plurality of elongated bars 132 to form a respective frame 106. In the depicted embodiment, the plurality of bar connectors 134 includes at least four 90-degree elbow bar connectors 136 and at least one tee bar connector 138.

As depicted in the partial section of FIG. 3, each bar connector 134 may contain one or more annular sockets 142 adapted to receive a cylindrical end portion of a respective elongated bar 132, as shown. In some embodiments of the present disclosure, some of the bar connector 134 may be assembled using a friction fit so that portions of the frame may be disassembled for compact storage. In other embodiments of the present disclosure, portions of the frame may be permanently joined via welding, melting, physical attachment (i.e. bolting) and/or adhesive bonding, depending on the materials selected for making respective components. Upon reading this specification, it should be appreciated that, under appropriate circumstances, considering such issues as user preferences, design preference, structural requirements, marketing preferences, cost, available materials, technological advances, etc., other frame arrangements such as, for example, forming the frame as a unitary element, providing unitary molded end members having alternate shapes, using bar members having alternate cross-sectional shapes, etc., may be sufficient.

In reference to FIG. 2 and FIG. 3, each frame 106 includes at least one coupler 144 configured to removably couple a hoop member 104 with at least one other hoop member 104 of the plurality, as shown. Each coupler 144 includes at least one tee bar connector 138 and a connector bar segment 146 configured to interconnect the tee bar connector 138 with one other tee bar connector 138 of the plurality of hoop members 104. Note that the small upper frame 106 includes only one tee bar connector 138, while the middle and lower frames 106 each include two tee bar connectors 138 locate on opposing horizontal elongated bars 132.

Figure 4:
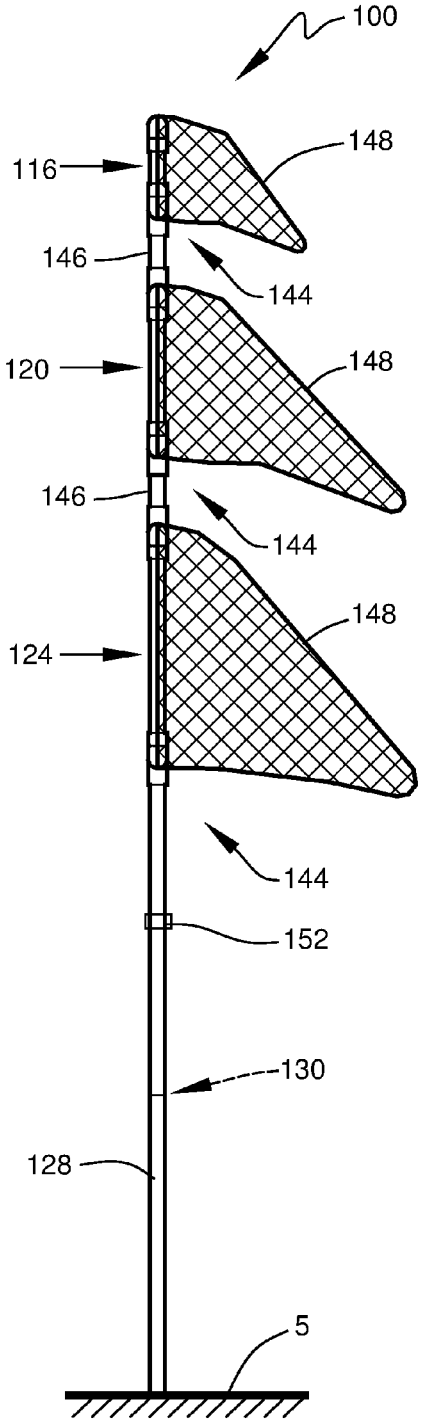

FIG. 4 is a side view of the target game device 102 of FIG. 1, according to an embodiment of the present disclosure. Each of the frames 106 includes a pocket-shaped capture net 148 configured to capture the hand-tossable item 110 passing through an elongated central opening 108 (see also FIG. 1). The flexible material forming the capture net 148 may be constructed of a durable and water-resistant plastic polymer and may be coupled to the frame using a mechanical fasteners. In one embodiment of the present disclosure, the capture net 148 may be joined to the frame with plastic cable ties. A preferred color may be provided to the capture net 148 by coating, mixing or blending the material forming the capture net 148 with a pigment and/or dye, or by other well-known methods.

Referring again to FIG. 2, one embodiment of the present disclosure, the vertical support member 128 may be equipped with a score-keeping accessory 152 allowing players to keep track of awarded points. The score-keeping accessory 152 may comprise a ring or similar feature that may be rotated or slid up and down the vertical support member 128 as points are awarded. A set of numbers or other indicia indicating earned points may be imprinted on ring or on the vertical support member 128, as shown. Upon reading this specification, it should be appreciated that, under appropriate circumstances, considering such issues as user preferences, design preference, structural requirements, marketing preferences, cost, available materials, technological advances, etc., other score-keeping arrangements such as, for example, paper scorecards, integrated electronic displays, software applications running on a player's mobile device, etc., may be sufficient.

Figure 5:
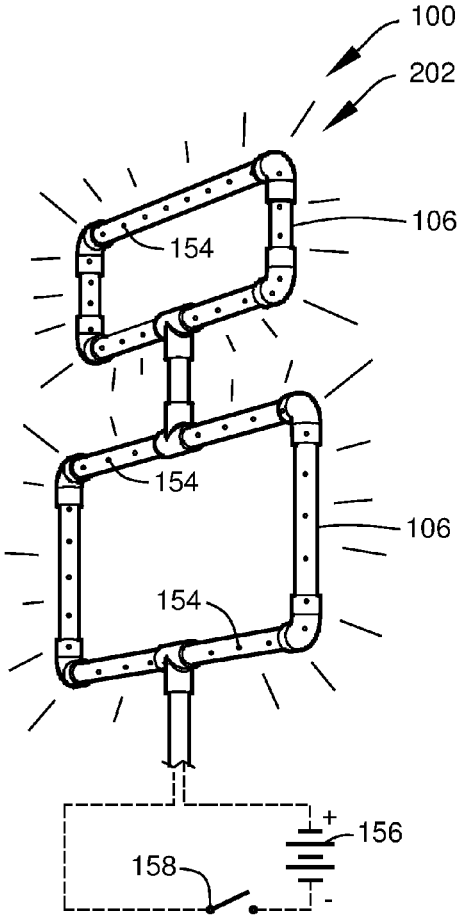
FIG. 5 is a perspective view of an illuminated target game device, according to another embodiment of the present disclosure.

FIG. 5 is a diagrammatic perspective view of an illuminated target game device 202 of the target game system 100, according to another embodiment of the present disclosure. In the depiction of FIG. 5, the capture nets have been omitted from the view for clarity of description. Also, the depicted embodiment contains only two hoop members to demonstrate the modularity and versatility of the present apparatus. It should be appreciated that the present embodiment may include any selected number of hoop members.

The illuminated target game device 202 includes an illumination source to permit the apparatus to be used at night. In one arrangement, the illuminated target game device 202 includes an arrangement of light emitting diodes 154. The light emitting diodes 154 may be mounted on or within the frame 106. If mounted within the frame 106, the frame components may be constructed from a transparent or translucent material passing light. A preferred color may be provided to the transparent portions of the frame by coating, mixing or blending the material forming the components with a pigment and/or dye, or by other well-known methods. Alternately, the light emitting diodes 154 may be supplied in a selected color. Upon reading this specification, it should be appreciated that, under appropriate circumstances, considering such issues as user preferences, design preference, structural requirements, marketing preferences, cost, available materials, technological advances, etc., other illumination arrangements such as, for example, providing a circuit and logic allowing the color of the light emitting diodes to cycle between multiple colors, providing sensors and circuit logic to illuminate the apparatus in a manner alerting the players that a goal has been achieved, using "glow-in-the-dark" materials, etc., may be sufficient.

The illuminated target game device 102 may include an onboard power source 156 in the form of one or more replaceable batteries. A switch 158 may be included to permit a user to selectively activate or deactivate the operation of the illumination source.

Figure 6:
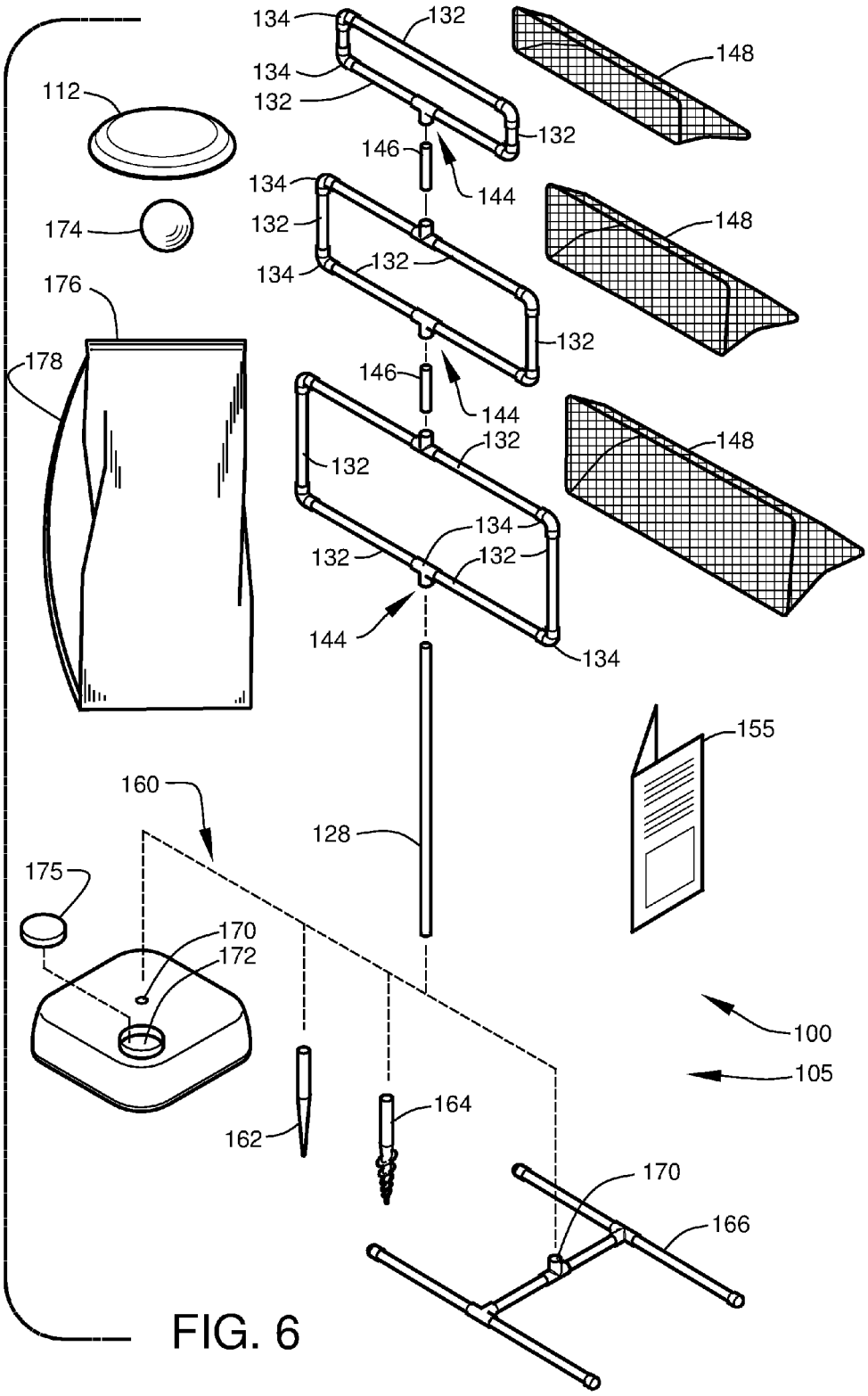
FIG. 6 is an exploded view of the target game system of FIG. 1, according to embodiments of the present disclosure.

FIG. 6 is an exploded view of the target game system 100 of FIG. 1, according to embodiments of the present disclosure. Visible in FIG. 6 is the first hoop member 116, the second hoop member 120, the third hoop member 124, and the vertical support member 128. The hoop members 104 include the elongated bars 132, bar connectors 134, and couplers 144, as shown. Also visible in FIG. 6 are three capture nets 148 detached from their respective frames.

The vertical support member 128 may further include at least one ground-engaging stabilizer 160 configured to support and positionally stabilize the vertical support member 128 and hoop assembly by engagement with the ground surface 5 (see FIG. 1). In one embodiment of the present disclosure, the ground-engaging stabilizer 160 includes a spike 162 configured to be driven into a ground surface. In this version, the spike 162 may be joined integrally with the vertical support member 128 or may be a separate unit allowing other ground-engaging stabilizers 160 to be selected and used, depending on the nature of the ground surface.

In another embodiment of the present disclosure, the ground-engaging stabilizer 160 comprises a helical auger tip 164 configured to be driven, in a screw-like manner, into soil or sand by a rotational movement. In this alternate version, the auger tip 164 may be joined integrally with the vertical support member 128 or may be a separate unit. The auger tip 164 may include deployable grips (not shown) to assist the user in twisting the auger tip 164 into the soil or sand.

In another embodiment of the present disclosure, the ground-engaging stabilizer 160 consists of a set of support legs 166 projecting outwardly from the vertical support member 128. The support legs may be formed substantially of the same material at that of the vertical support member 128 and hoop members 104. The support legs 166 may include a receiving socket 170 configured to removably receive the lower end of the vertical support member 128, as shown. Alternately, the support legs 166 may be foldable or retractable for compact storage.

In yet another embodiment of the present disclosure, the ground-engaging stabilizer 160 comprises a weighted base 168 that is configured rest on a dense ground surface 5, such as concrete or asphalt paving. The weighted base 168 includes a receiving socket 170 configured to removably receive the lower end of the vertical support member 128, as shown. The weighted base 168 may include a hollow cavity 172 configured to receive a flowable ballast material such as sand or water. The hollow cavity 172 may be sealed with a removable cap 175, as shown.

One advantage of the weighted base 168 is that the weighted base 168 can be used to set up target game devices 102 on indoors floor surfaces for indoor play. Because the density of the weighted base 168 can be made greater than that of water, the weighted base 168 can be also be used to set up target game devices 102 in a pool, lake, or ocean. The beach versions of the system may use either a flying disc 112 or a skipping-type ball 174 a well-known design configured for water play.

According to one embodiment, the target game system 100 may be arranged as a kit 105. In particular, the target game system 100 may further include a pair of the target game devices 102 along with a set of instructions 155. The instructions 155 may detail functional relationships in relation to the structure of the target game system 100 (such that the target game system 100 can be used, maintained, or the like, in a preferred manner).

Instructions 155 may include both assembly instructions and play instructions. It should be noted that many forms of game play may be developed using the disclosed devices. One example set of play instructions may include the following:

1) Instruction for placing a pair of target game devices at a selected distance.
2) Instruction for dividing players into two teams comprising two or more players, members of the same team standing at opposite target game devices.
3) Instruction for choosing a first team to throw the tossable item toward the target game device, the members of the first team taking alternate turns throwing and deflecting the tossable item.
4) Instruction for throwing the tossable item from a position behind the target game device adjacent to the team member.
5) Instruction for allowing a player to deflect the tossable item into a hoop during a throw while prohibiting the blocking of a throw by an opposing team.
6) Instruction for awarding three points to a team player if the tossable item passes through a small-sized hoop.
7) Instruction for awarding two points to a team player if the tossable item passes through a mid-sized hoop.

8) Instruction for awarding one point to a team player if the tossable item passes through a large-sized hoop.
9) Instruction for passing the tossable item to opposing team after both team members complete one throw each.
10) Instruction for winning a game by achieving a predetermined number of points.

According to another embodiment of the present disclosure, the kit 105 may further include the flying disc 112 of FIG. 1, a skipping-type ball 174, a storage bag container 176, or various combinations of these items. The storage bag container 176 may include a shoulder strap 178 and is intended to allow all components of the disassembled target game device 102 to be conveniently and easily transported and stored. It is noted that flying discs 112 suitable for use in kit 105 include but are not limited to flying discs sold under the well-known Frisbee® brand. Upon reading this specification, it should be appreciated that, under appropriate circumstances, considering such issues as user preferences, design preference, structural requirements, marketing preferences, cost, available materials, technological advances, etc., the use of other tossable items and game arrangements such as, for example, flying rings, foam balls, bean bags, dart-like balls, self-illuminated devices for night play, game devices using rackets, balls using lacrosse-type equipment, etc., may be sufficient.

Components of the target game devices 102 may be constructed from one or more light weight and durable materials. For example, the components forming the plurality of hoop members 104 and the vertical support member 128 may be constructed from one or more rigid materials consisting of plastic or metallic materials such as aluminum. Carbon-fiber composites may be used where a high performance apparatus is demanded. Although it is preferred that a single material be used in the construction of target game devices 102 (to reduce production costs), those skilled in the art, upon reading the teachings of this specification, will appreciate that, under appropriate circumstances, multiple materials may be employed. A preferred color may be provided to the selected materials by coating, mixing or blending the material forming the components with a pigment and/or dye, or by other well-known methods. Under appropriate circumstances, the present apparatus may include other markings or indicia to promote a particular brand, a team, or similar themes.

Figure 7:
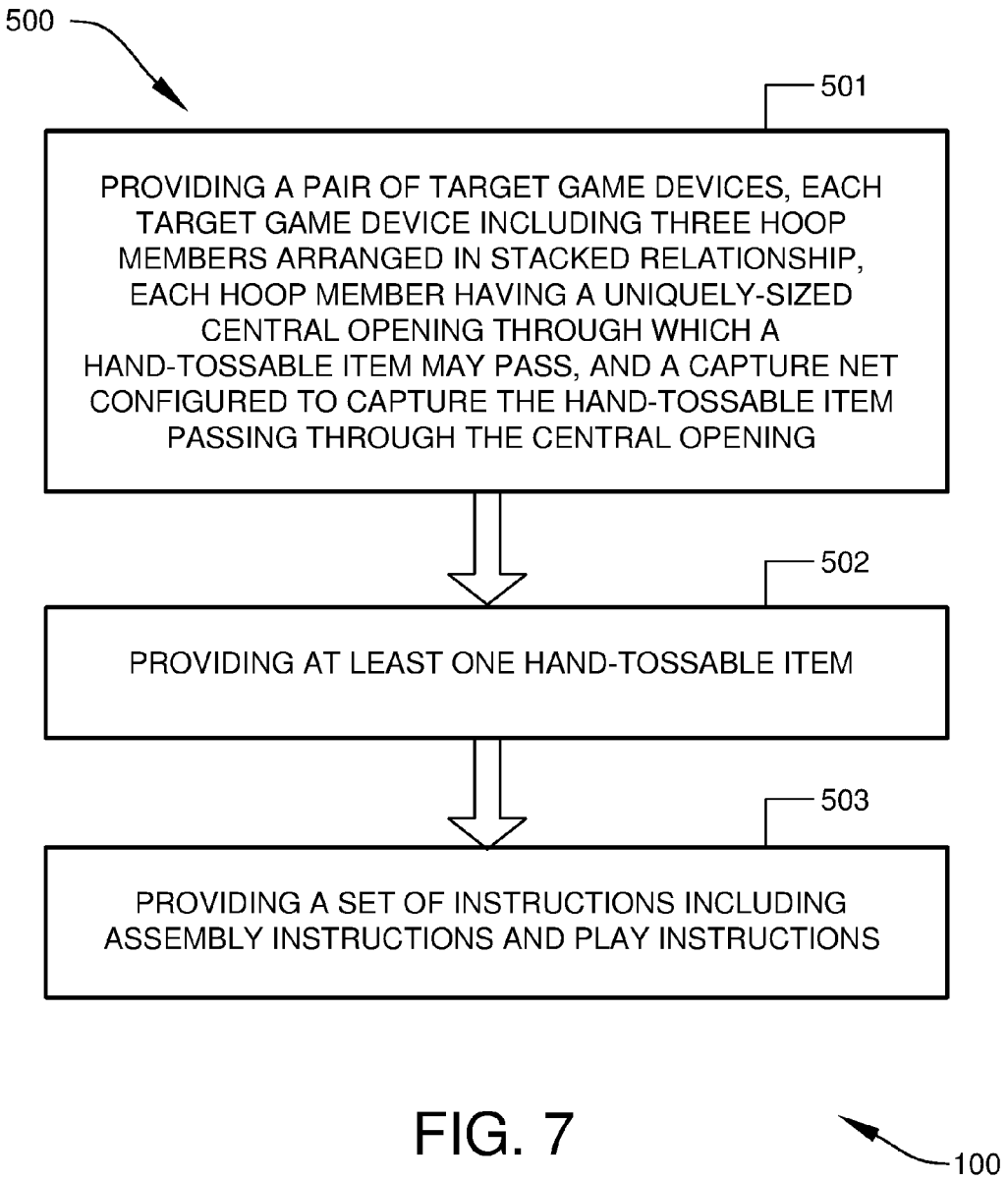
FIG. 7 is a flow diagram illustrating a method of use for target game system, according to an embodiment of the present disclosure.

FIG. 7 is a flow diagram illustrating a method of the target game system 100, according to an embodiment of the present disclosure. In particular, the target game method 500 may include one or more components or features of the target game system 100 as described above. As illustrated, the target game method 500 may include the steps of: step one 501, providing a pair of target game devices, each target game device including three hoop members arranged in stacked relationship, each hoop member having a uniquely-sized central opening through which a hand-tossable item may pass and a capture net configured to capture the hand-tossable item passing through the central opening; step two 502, providing at least one hand-tossable item; and; step three 503, providing a set of instructions including assembly instructions and play instructions.

It should be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for implementing the target game system (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A target game system comprising:

i) a target game device, the target game device including ii) a plurality of hoop members arranged in stacked relationship, each hoop member including:

(a) a frame defining an elongated central opening through which a tossable item may pass, the elongated central opening having an opening width greater than an opening height, (b) coupled to the frame, a capture net configured to capture the tossable item passing through the central opening, and (c) at least one coupler comprising at least one tee bar connector and a connector bar segment configured to interconnect the tee bar connector with one other tee bar connector of the plurality of hoop members; and iii) a vertical support member configured to support the plurality of hoop members above a ground surface, the vertical support member including a ground-engaging stabilizer configured to positionally stabilize the vertical support member by engagement with the ground surface;

iv) wherein said at least one coupler is configured to removably couple the hoop member with at least one other hoop member of the plurality;

v) wherein the elongated central opening of each hoop member comprises an opening area differing from the opening area of each of the other hoop members of the plurality of loop members;

vi) wherein the plurality of hoop members includes a first hoop member having a first elongated central opening, a second hoop member having a second elongated central opening, and a third hoop member having a third elongated central opening;

vii) wherein the frame of each hoop member comprises a plurality of elongated bars and a plurality of bar connectors, the plurality of bar connectors configured to interconnect the plurality of elongated bars;

viii) wherein the plurality of bar connectors includes at least four 90-degree elbow bar connectors and at least one tee bar connector;

ix) wherein the vertical support member includes a height adjuster configured to adjust the height of the plurality of hoop members relative to the ground structure; and x) wherein the ground-engaging stabilizer comprises at least one member of the group consisting of a helical auger tip configured to be rotationally driven into the ground surface.

2. The target game system of claim 1, wherein ii) the first elongated central opening comprises a first opening width of about 20 inches and a first opening height of about 4 inches;

iii) the second elongated central opening comprises a second opening width of about 25 inches and a second opening height of about 8 inches; and iv) the third elongated central opening comprises a third opening width of about 30 inches and a third opening height of about 12 inches.

3. The target game system of claim 1, wherein the ground-engaging stabilizer comprises a weighted base configured rest on the ground surface, the weighted base having a socket configured to removably receive the vertical support member.

4. The target game system of claim 3, wherein the weighted base comprises a cavity configured to receive a flowable ballast material.

5. The target game system of claim 1, wherein the ground-engaging stabilizer comprises a spike configured to be driven into the ground surface.

6. The target game system of claim 1, wherein the ground-engaging stabilizer comprises an auger configured to be rotationally driven into the ground surface.

7. The target game system of claim 1, wherein the ground-engaging stabilizer comprises a set of support legs projecting outwardly from the vertical support member.

8. The target game system of claim 1, wherein the target game system is constructed from at least one member of the group consisting of (a) a plastic material, (b) a carbon-fiber composite, and (c) a metallic material.

9. The target game system of claim 1, wherein target game system is self-illuminated.

10. The target game system of claim 9, wherein target game system comprises an arrangement of light emitting diodes and an onboard power source.

11. The target game system of claim 1, further comprising a pair of target game devices.

12. A target game system comprising:

i) a target game device, the target game device including ii) a plurality of hoop members arranged in stacked relationship, each hoop member having (a) a frame defining an elongated central opening through which a tossable item may pass, the elongated central opening having an opening width greater than an opening height, (b) coupled to the frame, a capture net configured to capture the tossable item passing through the central opening, and (c) at least one coupler configured to removably couple the hoop member with at least one other hoop member of the plurality;

iii) a vertical support member configured to support the plurality of hoop members above a ground surface, the vertical support member including a ground-engaging stabilizer configured to positionally stabilize the vertical support member by engagement with the ground surface;

iv) wherein the elongated central opening of each hoop member comprises an opening area differing from the opening area of each of the other hoop members of the plurality;

v) wherein the plurality of hoop members includes a first hoop member having a first elongated central opening, a second hoop member having a second elongated central opening, and a third hoop member having a third elongated central opening;

vi) the first elongated central opening comprises a first opening width of about 20 inches and a first opening height of about 4 inches;

vii) the second elongated central opening comprises a second opening width of about 25 inches and a second opening height of about 8 inches;

viii) the third elongated central opening comprises a third opening width of about 30 inches and a third opening height of about 12 inches;

ix) wherein the frame of each hoop member comprises a plurality of elongated bars and a plurality of bar connectors, the plurality of bar connectors configured to interconnect the plurality of elongated bars;

x) wherein the plurality of bar connectors includes at least four 90-degree elbow bar connectors and at least one tee bar connector;

xi) wherein the at least one coupler comprises at least one tee bar connector and a connector bar segment configured to interconnect the tee bar connector with one other tee bar connector of the plurality of hoop members;

xii) wherein the vertical support member includes a height adjuster configured to adjust the height of the plurality of hoop members relative to the ground structure;

xiii) wherein the ground-engaging stabilizer comprises at least one member of the group consisting of (a) a weighted base configured rest on the ground surface, (b) a spike configured to be driven into the ground surface, (c) an auger configured to be rotationally driven into the ground surface, and (d) a set of support legs projecting outwardly from the vertical support member;

xiv) wherein the weighted base comprises a cavity configured to receive a flowable ballast material and a socket configured to removably receive the vertical support member;

xv) wherein the vertical support member comprises an elongated cylindrical bar;

xvi) wherein the target game device is constructed substantially of at least one member of the group consisting of a plastic material, a carbon-fiber composite, and a metallic material, and a self-illuminating material.

13. The target game system of claim 12, further comprising i) a pair of the target game devices;

ii) at least one tossable item;

iii) set of instructions; and iv) wherein the target game system is arranged as a kit.

14. The target game system of claim 12, further comprising at least one storage bag.

* * * * *